US011017964B2

(12) United States Patent
Wu

(10) Patent No.: US 11,017,964 B2
(45) Date of Patent: May 25, 2021

(54) MIDDLE ILLUMINATED BUTTON SWITCH

(71) Applicant: Dongguan City Kaihua Electronics Co., Ltd, Guangdong (CN)

(72) Inventor: FuXi Wu, Guangdong (CN)

( * ) Notice: Subject to any disclaimer, the term of this patent is extended or adjusted under 35 U.S.C. 154(b) by 0 days.

(21) Appl. No.: 16/649,128

(22) PCT Filed: Aug. 27, 2018

(86) PCT No.: PCT/CN2018/102482
§ 371 (c)(1),
(2) Date: Mar. 19, 2020

(87) PCT Pub. No.: WO2019/056924
PCT Pub. Date: Mar. 28, 2019

(65) Prior Publication Data

US 2020/0294735 A1 Sep. 17, 2020

(30) Foreign Application Priority Data

Sep. 25, 2017 (CN) ..... 201710877069.6

(51) Int. Cl.
*H01H 13/02* (2006.01)
*H01H 13/14* (2006.01)
*H01H 13/50* (2006.01)

(52) U.S. Cl.
CPC ..... *H01H 13/023* (2013.01); *H01H 13/14* (2013.01); *H01H 13/50* (2013.01); *H01H 2219/062* (2013.01); *H01H 2233/07* (2013.01)

(58) Field of Classification Search
CPC ..... H01H 13/83; H01H 13/88; H01H 13/063; H01H 13/14; H01H 13/50; H01H 13/023;
(Continued)

(56) References Cited

U.S. PATENT DOCUMENTS 4,968,860 A * 11/1990 Shinohara ..... H01H 13/023 200/314
5,285,037 A * 2/1994 Baranski ..... H01H 13/70 200/314

(Continued)

FOREIGN PATENT DOCUMENTS

CN 203339029 U 12/2013
CN 204011192 U 12/2014

(Continued)

OTHER PUBLICATIONS

Translation CN203339029 (Original document published Dec. 11, 2013) (Year: 2013).*

(Continued)

*Primary Examiner* — William A Bolton
(74) *Attorney, Agent, or Firm* — ZANIP

(57) ABSTRACT

A middle illuminated button switch including a printed circuit board (PCB), a base and a cover. A guide core is arranged between the base and the cover, a through hole is arranged at the bottom of the base and under the guide core. A light guide groove is provided at the lower end surface of the guide core. A light-emitting element is arranged on the upper end of the PCB, and the light-emitting element is inserted into the base from the through hole and embedded in the light guide groove. Since the light-emitting element is embedded in the base from the bottom to the top, and the light is emitted to the outside from the middle through the guide core, so as to realize the light-emitting effect in the middle of the button.

8 Claims, 5 Drawing Sheets

(58) Field of Classification Search
CPC ..... H01H 2219/062; H01H 2233/07; H01H 9/161; H01H 2009/164; H01H 9/162
USPC ..... 200/310, 313, 314, 341, 340, 292, 520, 200/512, 510
See application file for complete search history.

(56) References Cited

U.S. PATENT DOCUMENTS

| | | | | |
|---|---|---|---|---|
| 5,391,848 | A * | 2/1995 | Murphy | H01H 13/023 200/314 |
| 5,813,519 | A * | 9/1998 | Gotoh | H01H 15/025 200/313 |
| 6,388,220 | B1 * | 5/2002 | Sasaki | H01H 1/5805 200/315 |
| 7,235,752 | B1 * | 6/2007 | Chen | H01H 13/83 200/310 |
| 2012/0160642 | A1 * | 6/2012 | Liao | H01H 13/023 200/310 |

FOREIGN PATENT DOCUMENTS

| | | | |
|---|---|---|---|
| CN | 206412272 | U | 8/2017 |
| CN | 107680855 | A | 2/2018 |
| CN | 207441526 | U | 6/2018 |

OTHER PUBLICATIONS

Translation CN2064122272 (Original document published Aug. 15, 2017) (Year: 2017).*
International search report of PCT/CN2018/102482.

* cited by examiner

MIDDLE ILLUMINATED BUTTON SWITCH

CROSS REFERENCE TO RELATED DISCLOSURE

This disclosure claims priority and rights of patent disclosures filed with the State Intellectual Property Office of China on Sep. 25, 2017, with patent disclosure numbers of 201710877069.6, and the PCT application No. PCT/CN2018/102482, and the entire contents of which are incorporated herein by reference.

TECHNICAL FILED

The present disclosure relates to a button switch, in particular to a middle illuminated button switch.

BACKGROUND

The illuminated button switch refers to a button switch provided with a built-in light-emitting structure which illuminates the button switch. In the existing illuminated button switch, a light-emitting element (such as a light-emitting diode) that directly extends into the switch is usually provided on a circuit board to achieve a light-emitting effect. Generally, the middle structure of a button switch is provided to supply a guiding force for the guide core to move up and down. Therefore, in a conventional illuminated button switch, a light-emitting element is usually embedded in the side of the button switch to make the button switch generate light effects. However, due to the internal structural design of the button switch, it has a light shielding effect, and the light does not spread to the middle and the outside of the button switch, or only the edge emits light but the middle does not emit light, which causes the poor luminous effect of the whole button switch.

SUMMARY

In view of the above-mentioned defect, an object of the present disclosure is to provide a middle illuminated button switch, which achieves a light-emitting effect in the middle part of the button switch, and has a good luminous effect.

The technical solution adopted by the present disclosure to achieve the foregoing objective is:

A middle illuminated button switch including a printed circuit board (PCB), a base provided on the PCB and a cover covered on the base. The cover and the base are combined to form an accommodating cavity, a guide core, a conduction assembly located on a side of the guide core and a spring located under the guide core are disposed in the accommodating cavity, respectively. An upper opening is provided on the upper end of the cover for the upper end of the guide core to move up and down. A through hole is provided at the bottom of the base, and a guide post protrudes upward from the edge of the through hole. The lower end of the spring is sleeved on the periphery of the guide post. A light-emitting element is arranged on the upper end of the PCB, and the light-emitting element is inserted into the base from the through hole. The light-emitting element is embedded in the base from the bottom to the top, and the light spreads to the outside from the middle of the button through the guide core, so as to realize the light-emitting effect in the middle of the button.

As a further improvement of the present disclosure, the light-emitting element is an LED lamp.

As a further improvement of the present disclosure, a light guide groove is provided on the lower end surface of the guide core for the upper end of the spring to be inserted.

As a further improvement of the present disclosure, a ring groove is provided on the base and located around the guide post; a conduction assembly slot is provided on the base and located at one side of the ring groove for inserting the conduction assembly; a first side opening is opened on the inner sidewall of the conductive assembly slot.

As a further improvement of the present disclosure, a pressing block is disposed on one side of the guide core, a yielding slope is provided on an upper end of the pressing block; the conduction assembly includes a static piece and a movable contact spring which are inserted in the conduction assembly slot and are opposite to each other, wherein a stationary contact is provided on the side of the static piece, a movable contact corresponding to the stationary contact is provided on the movable contact spring, and a protrusion corresponding to the pressing block is provided on the side of the movable contact spring and extends toward the first side opening; the pressing block on the side of the guide core pushes the protrusion on the movable contact spring during the process of the guide core moving up and down to control the separation and contact of the movable contact on the side of the movable contact spring and the stationary contact on the side of the static piece, so as to achieve the disconnection and conduction of the button switch.

As a further improvement of the present disclosure, a torsion spring is provided on the base and located on the side of the guide core; a torsion spring slot is provided on the base and located on the other side of the ring groove for inserting the torsion spring; a second side opening is opened on an inner sidewall of the torsion spring slot, and one end of the torsion spring extends to the side of the second side opening; an elastic block moving up and down in the second side opening is provided in the other side of the guide core, the elastic block on the side of the guide core continuously bounces the torsion spring to make a sound during the upward and downward movement of the guide core.

As a further improvement of the present disclosure, a guide shaft is respectively provided on two opposite sides of the guide core, and a guide hole is provided inside the base and is located at the side of the guide post for inserting the guide shaft when the guide shaft moves up and down.

As a further improvement of the present disclosure, a guide block is respectively provided on two opposite sides of the cover, and the guide block extends downward from the two opposite sides of the cover; a side moving groove is provided on an inner side of the guide block for the guide shaft to move up and down.

As a further improvement of the present disclosure, the guide core includes a first guide core body and a first cross press shaft provided on an upper end surface of the first guide core body.

As a further improvement of the present disclosure, the guide core includes a second guide core body and a second cross press shaft provided on the second guide core body, wherein a mounting groove is provided at the upper end of the second guide core body, the second cross press shaft is disposed in the mounting groove, and an upper end surface of the second cross press shaft is flush with the upper end surface of the mounting groove.

The advantageous effects of the present disclosure are as below:

(1) By embedding the light-emitting element into the middle part of the button switch from the bottom to the top, and the light emitting upward from the middle part through the guide core, so that a light-emitting effect is generated, which achieves the objective of light emission in the middle part of the button switch, and the luminous effect is good;

(2) A guide structure is formed by combining the guide shaft on the side of the guide core, the guide hole in the base and the guide block on the side of the cover to provide a guiding function for the up and down movement of the guide core, and ensure that the guide core is moved up and down in the vertical direction with a high accuracy of structure movement, thereby improving the accuracy of the on and off of the button switch.

The above is an overview of the technical solution of the present disclosure. And the present disclosure will be further described in detail with following embodiment and the reference drawings.

DETAILED DESCRIPTION OF THE EMBODIMENTS

Figure 1:
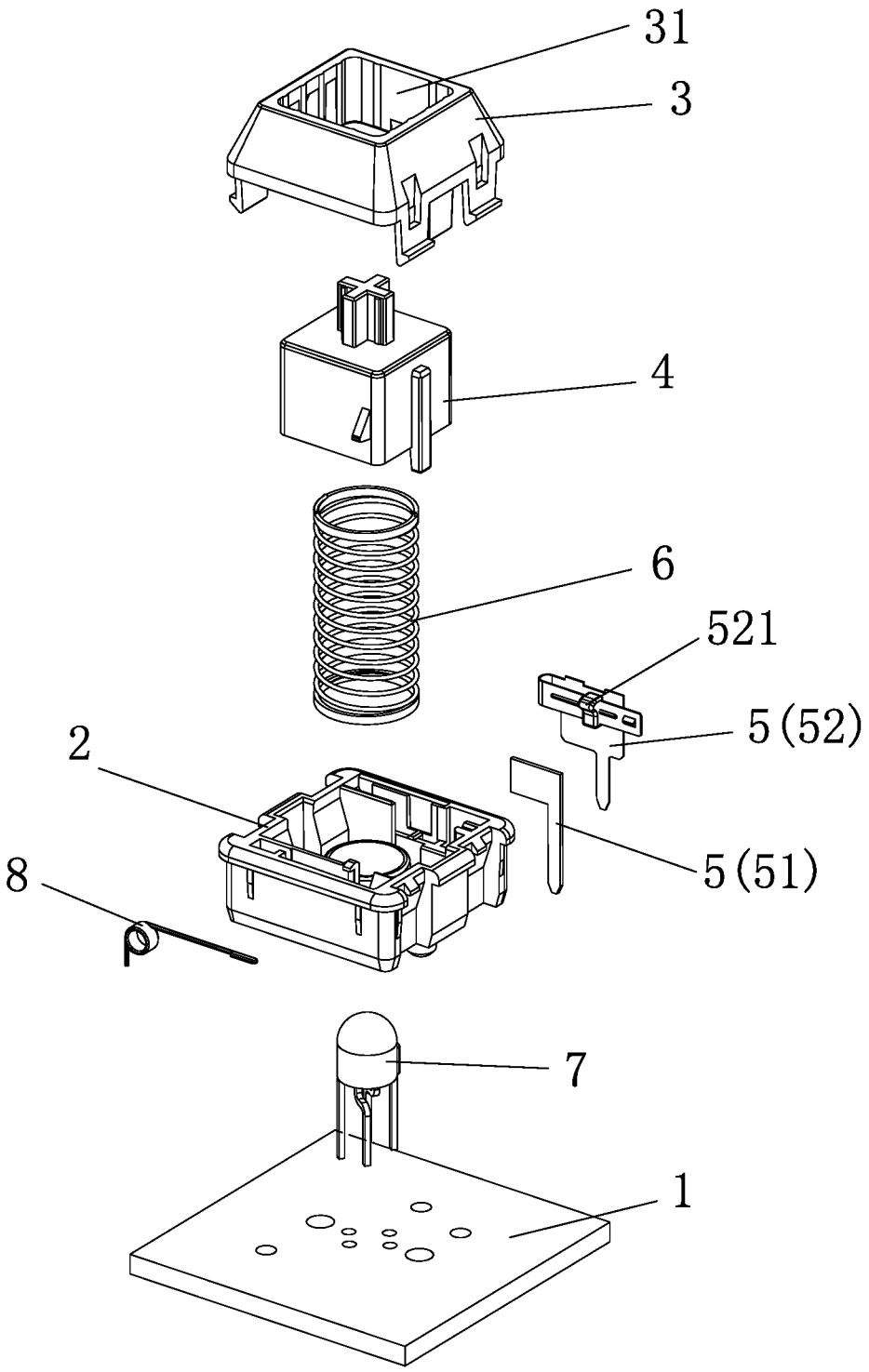
FIG. 1 is an exploded view of the present disclosure.

In order to further illustrate the technical means and effects adopted by the present disclosure to achieve a predetermined objective, the present disclosure is described in detail below with reference to the drawings and preferred embodiment.

Please refer to FIGS. 1 to 9, an embodiment of the present disclosure provides a middle illuminated button switch, which includes a printed circuit board (PCB) 1, a base 2 disposed on the PCB board 1, and a cover 3 covered on the base 2. The cover 3 is combined with the base 2 to faint an accommodating cavity, and a guide core 4, a conduction assembly 5 located on the side of the guide core 4, and a spring 6 located under the guide core 4 are respectively disposed in the accommodating cavity. An upper opening 31 is opened on the cover 3 for the guide core 4 to move up and down, A through hole 21 is provided at the bottom of the base 2, and a guide post 22 protrudes upward from the edge of the through hole 21. A lower end of the spring 6 is sleeved on the periphery of the guide post 22. And a light-emitting element 7 is provided on the upper end of the PCB, the light-emitting element 7 is inserted into the base 2 through the through hole 21. In this embodiment, the light-emitting element is an LED lamp.

Figure 3:
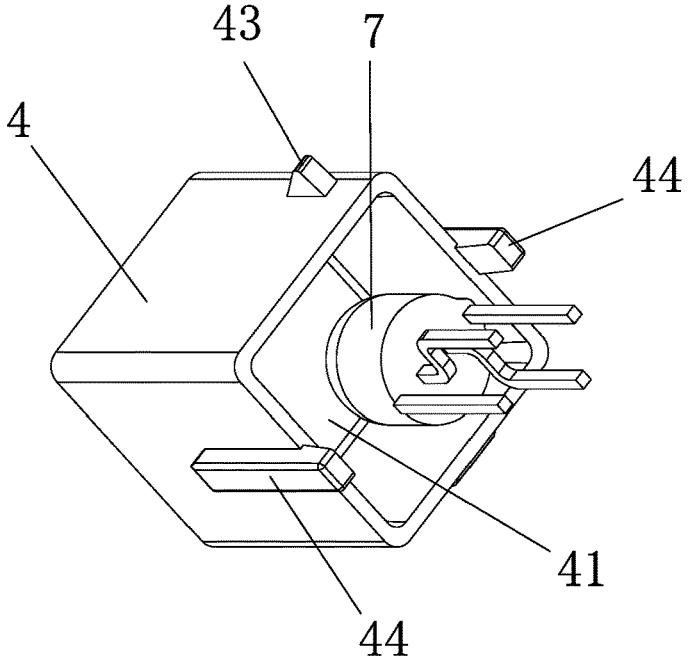
FIG. 3 is a schematic diagram showing the structure of the combination of a guide core and an LED lamp according to the present disclosure.

As shown in FIG. 3, a light guide groove 41 is formed on the lower end surface of the guide core 4 for the upper end of the spring 6 to be inserted. The light-emitting element 7 is inserted into the through hole 21 of the base 2 from the bottom and extends into the inner side of the spring 6. When the spring is pressed when the guide core 4 moves down, the upper portion of the light-emitting element 7 can be embedded into the light guide groove 41 on the lower end surface of the guide core 4 without damaging the light-emitting element 7, and maintaining a good light emitting effect.

Figure 2:
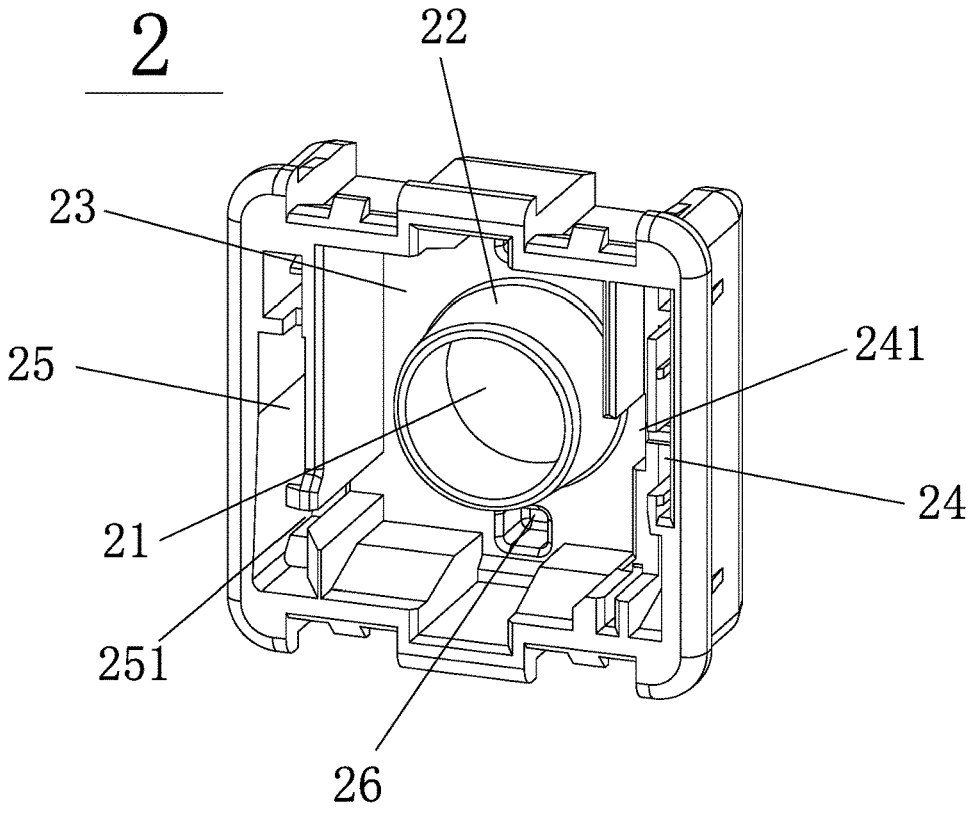
FIG. 2 is a schematic diagram showing the structure of a base of the present disclosure.

As shown in FIG. 2, a ring groove 23 is provided on the base 2 and located around the guide post 22, and a conduction assembly slot 24 is provided on the base 1 and located at one side of the ring groove 23 for inserting the conduction assembly 5. A first side opening 241 is opened on the inner sidewall of the conductive assembly slot 24.

As shown in FIG. 1, FIG. 4, FIG. 5 and FIG. 6, a pressing block 42 is provided on one side of the guide core 4, and a yielding slope 421 is provided on the upper end of the pressing block 42. The conduction assembly 5 includes a static piece 51 and a movable spring piece 52 which are inserted in the conduction assembly slot 24 and are opposite to each other. Wherein, a stationary contact is provided on the side of the static piece 51, and a movable contact corresponding to the stationary contact is provided on the movable contact spring 52. And a protrusion 521 corresponding to the pressing block 42 is provided on the side of the movable contact spring 52 and extends toward the first side opening 241. The pressing block 42 on the side of the guide core 4 pushes the protrusion 521 on the movable contact spring during the guide core moving up and down to control the separation and contact of the movable contact on the movable contact spring 52 and the stationary contact on the side of the static piece 51, so as to achieve the disconnection and conduction of the button switch.

As shown in FIG. 1, FIG. 2, FIG. 5 and FIG. 7, a torsion spring 8 is provided on the base 2 and on the side of the guide core 4. A torsion spring slot 25 is provided on the base 2 and located at the other side of the ring groove 23 for inserting the torsion spring 8. A second side opening 251 is opened on an inner sidewall of the torsion spring slot 25, and one end of the torsion spring 8 extends to the side of the second side opening 25. An elastic block 43 moving up and down in the second side opening 251 is provided in the other side of the guide core 4, the elastic block 43 on the side of the guide core 4 continuously bounces the torsion spring 8 to make a sound during the upward and downward movement of the guide core 4, so that the button switch has an effect and enhances a touch feeling.

Figure 8:
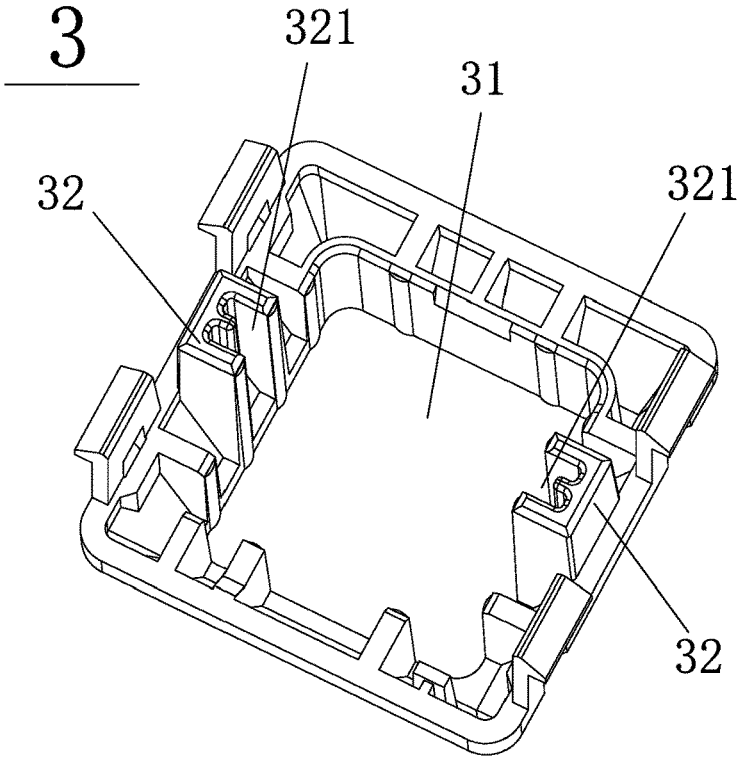
FIG. 8 is a schematic diagram showing the structure of a cover of the present disclosure.

As shown in FIG. 3, FIG. 4, FIG. 5, FIG. 6 and FIG. 7, a guide shaft 44 is respectively provided on opposite sides of the guide core 4, and a guide hole 26 are located at the base 2 and is, located at the side of the guide post 22 for inserting the guide shaft 44 when the guide shaft 44 moves up and down. At the same time, as shown in FIG. 8, a guide block 32 is, respectively provided on two opposite sides of the cover 3, and the guide block 32 extends downward from the two opposite sides of the cover 3. A side moving groove 321 is provided on an inner side of the guide block 32 for the guide shaft 44 to move up and down. A guide structure is formed by combining the guide shaft 44 on the side of the guide core 4, the guide hole 26 in the base 2 and the guide block 32 on the side of the cover 3 to provide a guiding function for the up and down movement of the guide core 4, and ensure that the guide core 4 is moved up and down in the vertical direction, so that the conduction and disconnection of the button switch can be realized by pressing.

Figure 4:
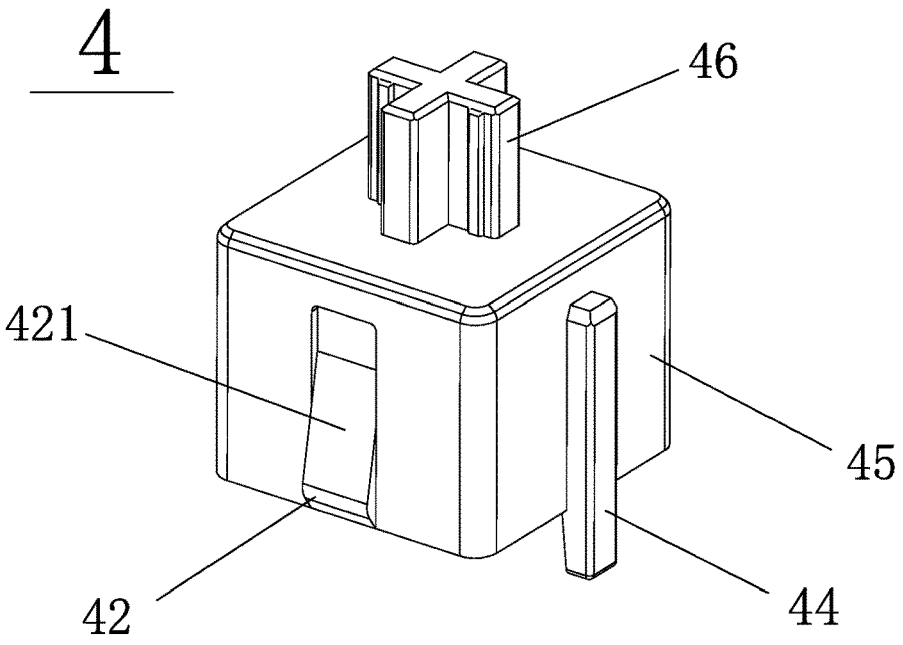
FIG. 4 is a schematic diagram showing the structure of a guide core according to the present disclosure.
Figure 5:
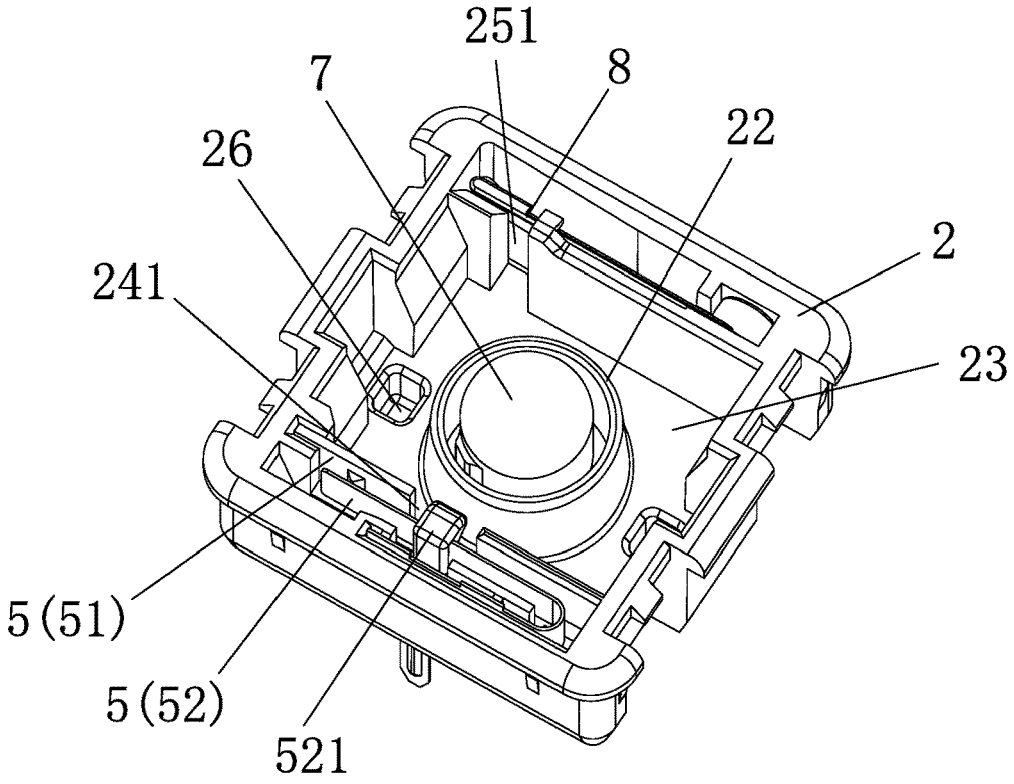
FIG. 5 is a schematic diagram showing the structure of the combination of the base and the LED lamp according to the present disclosure.
Figure 6:
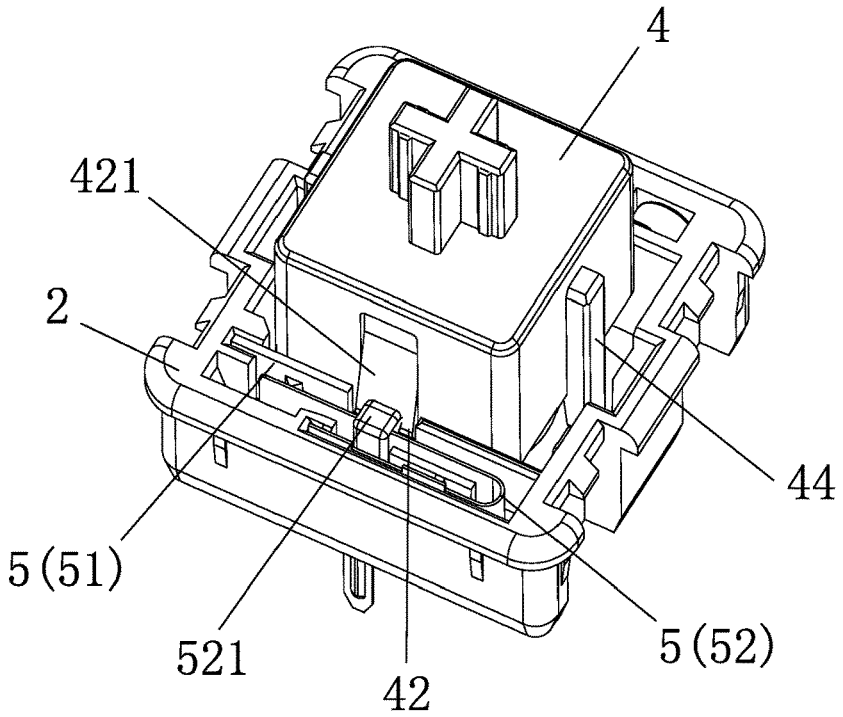
FIG. 6 is a schematic diagram showing the structure of a part of the present disclosure.
Figure 7:
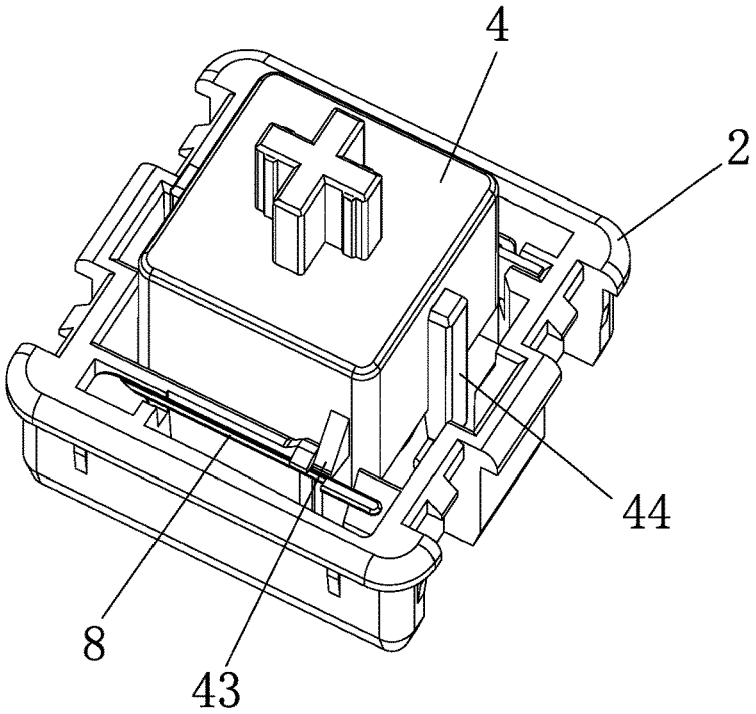
FIG. 7 is a schematic diagram showing the structure of another part of the present disclosure.

In this embodiment, the guide core 4 has two structures. As shown in FIG. 4, it is the first structure of the guide core 4. The guide core 4 includes a first guide core body 45 and a first cross press shaft 46 provided on an upper end surface of the first guide core body 45.

Figure 9:
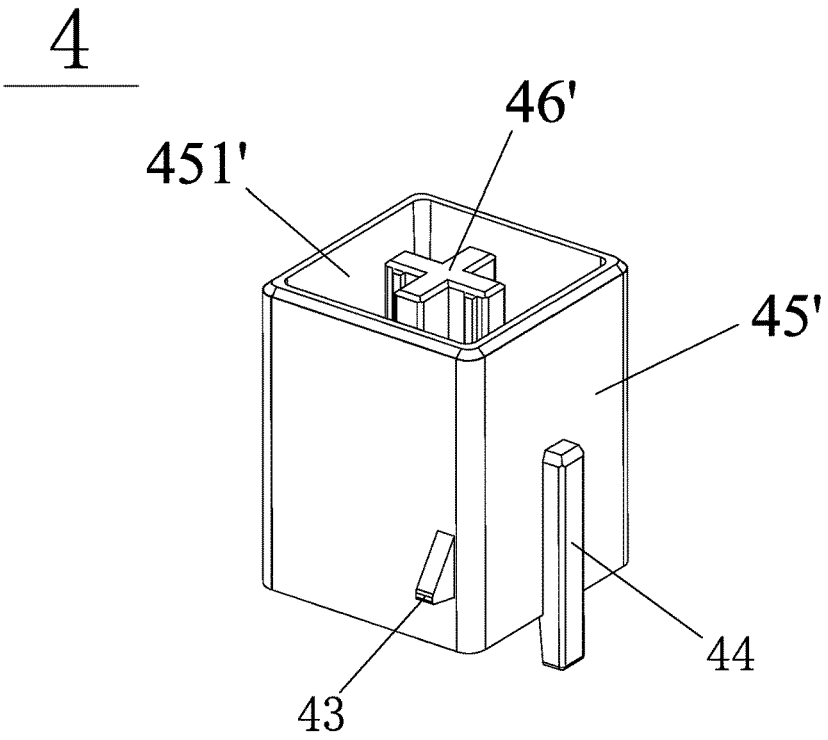
FIG. 9 is schematic diagram showing the another structure of the guide core according to the present disclosure.

As shown in FIG. 9, there shows the second structure of the guide core 4, the guide core 4 includes a second guide core body 45' and a second cross press shaft 46' provided on the second guide core body 45'. Wherein a mounting groove 451' is provided at the upper end of the second guide core body 45', the second cross press shaft 46' is disposed in the mounting groove 451', and an upper end surface of the second cross press shaft 46' is flush with the upper end surface of the mounting groove 451'.

When the button switch in a natural unpressed state, the pressing block 42 on the side of the guide core 4 pushes the protrusion 521 on the movable contact spring 52 to separate the movable contact on the movable contact spring 52 from the stationary contact on the side of the static piece 51, the button switch is in off state. When the button switch in working state, the guide core 4 is pressed downward, and the spring 6 is compressed when the guide core 4 moves down. At the same time, the pressing block 42 on the side of the guide core 4 is separated from the protrusion 521 on the side of the the movable contact spring 52, so that the protrusion 521 enters into the space above the slope 421, the movable contact spring 52 is reset, so that the movable contact on the movable contact spring 52 is in contact with stationary contact on the side of the static piece 51, and the button switch is in a conducting state. When the guide core 4 is released, the guide core 4 is reset by the elastic restoring force of the spring 6, and the button switch is turned off. In this process, the LED light is emitted, and the light is emitted upward from the middle through the guide core 4 to produce a luminous effect. Meanwhile, the elastic block 43 on the side of the guide core 4 bounces the torsion spring 8 to make a sound and enhances the touch feeling.

The main points of the present disclosure are as below:

(1) By embedding the light-emitting element into the middle part of the button switch from the bottom to the top, and the light emitting upward from the middle part through the guide core, so that a light-emitting effect is generated, which achieves the objective of light emission in the middle part of the button switch, and the luminous effect is good;

(2) A guide structure is formed by combining the guide shaft on the side of the guide core, the guide hole in the base and the guide block on the side of the cover to provide a guiding function for the up and down movement of the guide core, and ensure that the guide core is moved up and down in the vertical direction with a high accuracy of structure movement, thereby improving the accuracy of the on and off of the button switch.

The above description is only the preferred embodiments of the present disclosure, and does not limit the technical scope of the present disclosure. Therefore, other structures obtained by applying the same or similar technical features as those of the above embodiments of the present disclosure are all within the scope of the present disclosure.

What is claimed is:

1. A middle illuminated button switch comprising a printed circuit board (PCB), a base and a cover, a guide core is provided between the base and the cover, wherein a through hole is provided at a bottom of the base and is located under the guide core; a light guide groove is provided at a lower end surface of the guide core; a light-emitting element is arranged on an upper end of the PCB, the light-emitting element is inserted into the base from the through hole and embedded in the light guide groove; the light-emitting element is embedded in the base from a bottom to a top, and light spreads to outside from a middle of the button through the guide core, so as to realize a light-emitting effect in the middle of the button;

a ring groove is provided on the base; a guide shaft is respectively provided on two opposite sides of the guide core, and a guide hole is provided at a bottom of the ring groove for inserting the guide shaft when the guide shaft moves up and down;

a guide block is respectively provided on two opposite sides of the cover, and the guide block extends downward from the two opposite sides of the cover; a side moving groove is provided on an inner side of the guide block for the guide shaft to move up and down.

2. The middle illuminated button switch according to claim 1, wherein the cover and the base are combined to form an accommodating cavity, and a conduction assembly located on a side of the guide core and a spring located under the guide core are disposed in the accommodating cavity, respectively; an upper opening is provided on an upper end of the cover for an upper end of the guide core to move up and down; a guide post protrudes upward from an edge of the through hole; an upper end of the spring is embedded in the light guide groove and a lower end of the spring is sleeved on a periphery of the guide post.

3. The middle illuminated button switch according to claim 2, wherein the ring groove is located around the guide post; a conduction assembly slot is provided on the base and located at one side of the ring groove for inserting the conduction assembly; a first side opening is opened on an inner sidewall of the conductive assembly slot.

4. The middle illuminated button switch according to claim 2, wherein a pressing block is disposed on one side of the guide core, a yielding slope is provided on an upper end of the pressing block; the conduction assembly comprises a static piece and a movable contact spring which are inserted in the conduction assembly slot and are opposite to each other, wherein a stationary contact is provided on a side of the static piece, a movable contact corresponding to the stationary contact is provided on the movable contact spring, and a protrusion corresponding to the pressing block is provided on a side of the movable contact spring and extends toward the first side opening; the pressing block on the side of the guide core pushes the protrusion on the movable contact spring during the process of the guide core moving up and down to control a separation and contact of the movable contact on the side of the movable contact spring and the stationary contact on the side of the static piece, so as to achieve a disconnection and a conduction of the button switch.

5. The middle illuminated button switch according to claim 2, wherein a torsion spring is provided on the base and located on the side of the guide core; a torsion spring slot is provided on the base and located on the other side of the ring groove for inserting the torsion spring; a second side opening is opened on an inner sidewall of the torsion spring slot, and one end of the torsion spring extends to a side of the second side opening; an elastic block moving up and down in the second side opening is provided in the other side of the guide core, the elastic block on the side of the guide core continuously bounces the torsion spring to make a sound during the upward and downward movement of the guide core.

6. The middle illuminated button switch according to claim 1, wherein the light-emitting element is an LED lamp.

7. The middle illuminated button switch according to claim 1, wherein the guide core comprises a first guide core body and a first cross press shaft provided on an upper end surface of the first guide core body.

8. The middle illuminated button switch according to claim 1, wherein the guide core comprises a second guide core body and a second cross press shaft provided on the second guide core body, wherein a mounting groove is provided at an upper end of the second guide core body, the second cross press shaft is disposed in the mounting groove, and an upper end surface of the second cross press shaft is flush with an upper end surface of the mounting groove.

* * * * *